US008480197B2

(12) United States Patent
Nakanishi et al.

(10) Patent No.: US 8,480,197 B2
(45) Date of Patent: Jul. 9, 2013

(54) PRINTING APPARATUS AND PRINTING METHOD

(75) Inventors: Hideki Nakanishi, Kawasaki (JP); Hiroshi Uemura, Zushi (JP)

(73) Assignee: Canon Kabushiki Kaisha, Tokyo (JP)

( * ) Notice: Subject to any disclaimer, the term of this patent is extended or adjusted under 35 U.S.C. 154(b) by 558 days.

(21) Appl. No.: 12/620,997

(22) Filed: Nov. 18, 2009

(65) Prior Publication Data

US 2010/0149240 A1 Jun. 17, 2010

(30) Foreign Application Priority Data

Dec. 12, 2008 (JP) ..... 2008-317706

(51) Int. Cl.
*B41J 29/38* (2006.01)
*B41J 2/205* (2006.01)
*B41J 29/393* (2006.01)

(52) U.S. Cl.
USPC ..... 347/12; 347/5; 347/9; 347/14; 347/15; 347/19

(58) Field of Classification Search
USPC ..... 347/12, 15, 19
See application file for complete search history.

(56) References Cited

U.S. PATENT DOCUMENTS

| | | | | |
|---|---|---|---|---|
| 7,192,112 | B2 | 3/2007 | Nakanishi et al. | 347/14 |
| 7,192,114 | B2 | 3/2007 | Suzuki et al. | 347/19 |
| 7,347,523 | B2 | 3/2008 | Tatsumi | 347/19 |
| 2004/0165021 | A1 * | 8/2004 | Desie | 347/15 |
| 2005/0083361 | A1 | 4/2005 | Nakanishi et al. | 347/12 |
| 2007/0132805 | A1 | 6/2007 | Nakanishi et al. | 347/19 |
| 2007/0211101 | A1 * | 9/2007 | Yamanobe | 347/19 |
| 2008/0049055 | A1 | 2/2008 | Edamura et al. | |

FOREIGN PATENT DOCUMENTS

| | | |
|---|---|---|
| JP | 2004-202927 A | 7/2004 |
| JP | 2005-096424 | 9/2004 |
| JP | 2005-067191 | 3/2005 |
| JP | 2005-074944 | 3/2005 |
| JP | 2005-096232 | 4/2005 |
| JP | 2007-237563 A | 9/2007 |
| JP | 2008-049538 A | 3/2008 |

OTHER PUBLICATIONS

Communication Appln. No. 09014356.1-1251, European Patent Office, Feb. 26, 2010.
Office Action—Japanese Patent Application No. 2008-317706, Japanese Patent Office, mailed Nov. 16, 2012.

* cited by examiner

*Primary Examiner* — Ryan Lepisto
(74) *Attorney, Agent, or Firm* — Fitzpatrick, Cella, Harper & Scinto

(57) ABSTRACT

A printing apparatus which prints by discharging ink droplets from a first nozzle array and a second nozzle array based on print data using a printhead including the first nozzle array and the second nozzle array for discharging ink droplets of the same color and different discharge amounts, the apparatus comprising: a specifying unit configured to specify a discharge failure nozzle in the first nozzle array and the second nozzle array; and a controller configured to assign print data corresponding to the discharge failure nozzle specified by the specifying unit to a nozzle of a nozzle array different from a nozzle array to which the discharge failure nozzle belongs, out of the first nozzle array and the second nozzle array.

8 Claims, 16 Drawing Sheets

FIG. 1

| SEXADECIMAL DATA | SMALL DOTS [DOTS] | MIDDLE DOTS [DOTS] | LARGE DOTS [DOTS] | TOTAL INK AMOUNT [DOTS] ※ CONVERTED INTO SMALL DOTS |
|---|---|---|---|---|
| 0 | 0 | 0 | 0 | 0 |
| 1 | 1 | 0 | 0 | 1 |
| 2 | 2 | 0 | 0 | 2 |
| 3 | 1 | 1 | 0 | 3 |
| 4 | 2 | 1 | 0 | 4 |
| 5 | 1 | 2 | 0 | 5 |
| 6 | 2 | 2 | 0 | 6 |
| 7 | 1 | 1 | 1 | 7 |
| 8 | 2 | 1 | 1 | 8 |
| 9 | 1 | 2 | 1 | 9 |
| 10 | 2 | 2 | 1 | 10 |
| 11 | 1 | 1 | 2 | 11 |
| 12 | 2 | 1 | 2 | 12 |
| 13 | 1 | 2 | 2 | 13 |
| 14 | 2 | 2 | 2 | 14 |
| 15 | 1 | 1 | 3 | 15 |

FIG. 4A

| SEXADECIMAL | SMALL DOTS (DISCHARGE FAILURE) | MIDDLE DOTS | COMPLEMENTARY MIDDLE DOTS | LARGE DOTS | COMPLEMENTARY LARGE DOTS | TOTAL INK AMOUNT |
|---|---|---|---|---|---|---|
| 0 | 0 | 0 | 0 | 0 | 0 | 0 |
| 1 | 1 | 0 | 0 | 0 | 0 | 0 |
| 2 | 2 | 0 | 1 | 0 | 0 | 2 |
| 3 | 1 | 1 | 0 | 0 | 0 | 2 |
| 4 | 2 | 1 | 1 | 0 | 0 | 4 |
| 5 | 1 | 2 | 0 | 0 | 0 | 4 |
| 6 | 2 | 2 | 1 | 0 | 0 | 6 |
| 7 | 1 | 1 | 0 | 1 | 0 | 6 |
| 8 | 2 | 1 | 1 | 1 | 0 | 8 |
| 9 | 1 | 2 | 0 | 1 | 0 | 8 |
| 10 | 2 | 2 | 1 | 1 | 0 | 10 |
| 11 | 1 | 1 | 0 | 2 | 0 | 10 |
| 12 | 2 | 1 | 1 | 2 | 0 | 12 |
| 13 | 1 | 2 | 0 | 2 | 0 | 12 |
| 14 | 2 | 2 | 1 | 2 | 0 | 14 |
| 15 | 1 | 1 | 0 | 3 | 0 | 14 |

FIG. 4B

| SEXADECIMAL | SMALL DOTS | COMPLEMENTARY SMALL DOTS | MIDDLE DOTS (DISCHARGE FAILURE) | LARGE DOTS | COMPLEMENTARY LARGE DOTS | TOTAL INK AMOUNT |
|---|---|---|---|---|---|---|
| 0 | 0 | 0 | 0 | 0 | 0 | 0 |
| 1 | 1 | 0 | 0 | 0 | 0 | 1 |
| 2 | 2 | 0 | 0 | 0 | 0 | 2 |
| 3 | 1 | 2 | 1 | 0 | 0 | 3 |
| 4 | 2 | 2 | 1 | 0 | 0 | 4 |
| 5 | 1 | 0 | 2 | 0 | 1 | 5 |
| 6 | 2 | 0 | 2 | 0 | 1 | 6 |
| 7 | 1 | 2 | 1 | 1 | 0 | 7 |
| 8 | 2 | 2 | 1 | 1 | 0 | 8 |
| 9 | 1 | 0 | 2 | 1 | 1 | 9 |
| 10 | 2 | 0 | 2 | 1 | 1 | 10 |
| 11 | 1 | 2 | 1 | 2 | 0 | 11 |
| 12 | 2 | 2 | 1 | 2 | 0 | 12 |
| 13 | 1 | 0 | 2 | 2 | 1 | 13 |
| 14 | 2 | 0 | 2 | 2 | 1 | 14 |
| 15 | 1 | 2 | 1 | 3 | 0 | 15 |

FIG. 4C

| SEXADECIMAL | SMALL DOTS | COMPLEMENTARY SMALL DOTS | MIDDLE DOTS | COMPLEMENTARY MIDDLE DOTS | LARGE DOTS (DISCHARGE FAILURE) | TOTAL INK AMOUNT |
|---|---|---|---|---|---|---|
| 0 | 0 | 0 | 0 | 0 | 0 | 0 |
| 1 | 1 | 0 | 0 | 0 | 0 | 1 |
| 2 | 2 | 0 | 0 | 0 | 0 | 2 |
| 3 | 1 | 0 | 1 | 0 | 0 | 3 |
| 4 | 2 | 0 | 1 | 0 | 0 | 4 |
| 5 | 1 | 0 | 2 | 0 | 0 | 5 |
| 6 | 2 | 0 | 2 | 0 | 0 | 6 |
| 7 | 1 | 0 | 1 | 2 | 1 | 7 |
| 8 | 2 | 0 | 1 | 2 | 1 | 8 |
| 9 | 1 | 0 | 2 | 2 | 1 | 9 |
| 10 | 2 | 0 | 2 | 2 | 1 | 10 |
| 11 | 1 | 2 | 1 | 3 | 2 | 11 |
| 12 | 2 | 2 | 1 | 3 | 2 | 12 |
| 13 | 1 | 3 | 2 | 2 | 2 | 12 |
| 14 | 2 | 2 | 2 | 2 | 2 | 12 |
| 15 | 1 | 3 | 1 | 3 | 3 | 12 |

FIG. 5

| LEVEL | NORMAL TABLE | | | TABLE FOR COMPLEMENTING SMALL-DOT DISCHARGE FAILURE | | TABLE FOR COMPLEMENTING MIDDLE-DOT DISCHARGE FAILURE | | TABLE FOR COMPLEMENTING LARGE-DOT DISCHARGE FAILURE | |
|---|---|---|---|---|---|---|---|---|---|
| | SMALL | MIDDLE | LARGE | MIDDLE | LARGE | SMALL | LARGE | SMALL | MIDDLE |
| 0 | | | | | | | | | |
| 1 | ● | | | | | ● | | ● | |
| 2 | ● ● | | | ⊘ | | ● ● | | ● ● | |
| 3 | ● | ● | | ● | | ● ⊘ ⊘ | | ● | ● |
| 4 | ● ● | ● | | ⊘ ● | | ● ⊘ ⊘ ● | | ● ● | ● |
| 5 | ● | ● ● | | ● ● | | ● | ⊘ | ● | ● ● |
| 6 | ● ● | ● ● | | ⊘ ● ● | | ● ● | ⊘ | ● ● | ● ● |
| 7 | ● | ● | ● | ● | ● | ● ⊘ ⊘ | ● | ● | ⊘ ● ⊘ |
| 8 | ● ● | ● | ● | ⊘ ● | ● | ● ⊘ ⊘ ● | ● | ● ● | ⊘ ● ⊘ |
| 9 | ● | ● ● | ● | ● ● | ● | ● | ⊘ ● | ● | ⊘ ● ● ⊘ |
| 10 | ● ● | ● ● | ● | ⊘ ● ● | ● | ● ● | ⊘ ● | ● ● | ⊘ ● ● ⊘ |
| 11 | ● | ● | ● ● | ● | ● ● | ● ⊘ ⊘ | ● ● | ● ⊘ ⊘ | ⊘ ● ⊘ ⊘ |
| 12 | ● ● | ● | ● ● | ⊘ ● | ● ● | ● ⊘ ⊘ ● | ● ● | ● ⊘ ⊘ ● | ⊘ ● ⊘ ⊘ |
| 13 | ● | ● ● | ● ● | ● ● | ● ● | ● | ● ⊘ ● | ● ⊘ ⊘ ⊘ | ⊘ ● ● ⊘ |
| 14 | ● ● | ● ● | ● ● | ⊘ ● ● | ● ● | ● ● | ● ⊘ ● | ● ⊘ ⊘ ● | ⊘ ● ● ⊘ |
| 15 | ● | ● | ● ● ● | ● | ● ● ● | ● ⊘ ⊘ | ● ● ● | ● ⊘ ⊘ ⊘ | ⊘ ● ⊘ ⊘ |

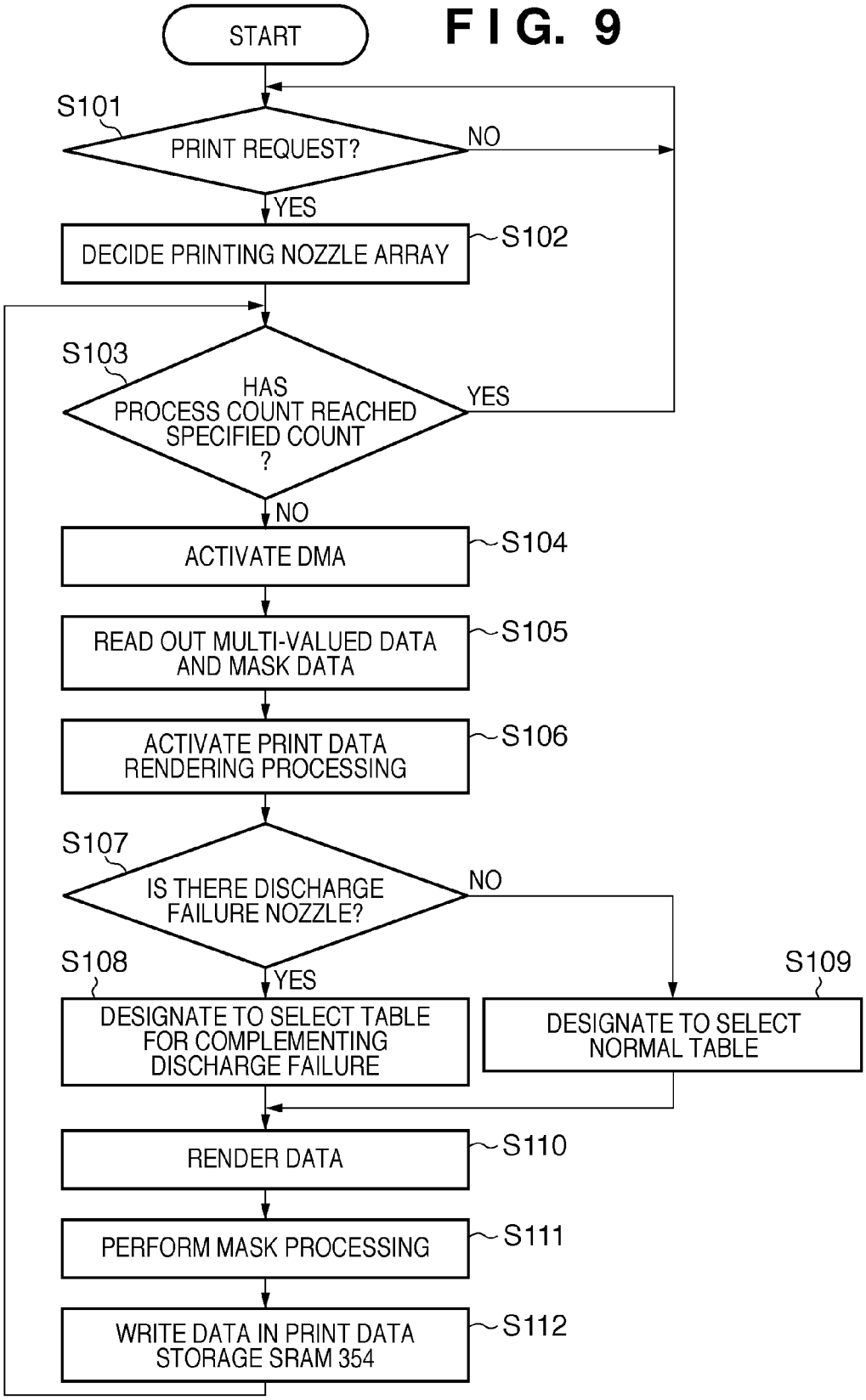
FIG. 9
START
S101
PRINT REQUEST?
NO
YES
DECIDE PRINTING NOZZLE ARRAY
S102
S103
HAS PROCESS COUNT REACHED SPECIFIED COUNT ?
YES
NO
ACTIVATE DMA
S104
READ OUT MULTI-VALUED DATA AND MASK DATA
S105
ACTIVATE PRINT DATA RENDERING PROCESSING
S106
S107
IS THERE DISCHARGE FAILURE NOZZLE?
NO
S108
YES
S109
DESIGNATE TO SELECT TABLE FOR COMPLEMENTING DISCHARGE FAILURE
DESIGNATE TO SELECT NORMAL TABLE
RENDER DATA
S110
PERFORM MASK PROCESSING
S111
WRITE DATA IN PRINT DATA STORAGE SRAM 354
S112

FIG. 11

| LEVEL | NORMAL TABLE | | | TABLE FOR COMPLEMENTING SMALL-DOT DISCHARGE FAILURE | | |
|---|---|---|---|---|---|---|
| | SMALL | MIDDLE | LARGE | MIDDLE #0 | MIDDLE #1 | LARGE |
| 0 | | | | | | |
| 1 | | | | | | |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |
| 11 | | | | | | |
| 12 | | | | | | |
| 13 | | | | | | |
| 14 | | | | | | |
| 15 | | | | | | |

PRINTING APPARATUS AND PRINTING METHOD

This application claims the benefit of Japanese Patent Application No. 2008-317706 filed on Dec. 12, 2008, which is hereby incorporated by reference herein in its entirety.

BACKGROUND OF THE INVENTION

1. Field of the Invention

The present invention relates to a printing apparatus and printing method.

2. Description of the Related Art

An inkjet printing apparatus includes a printhead having a plurality of nozzles. If even one discharge failure nozzle exists in the nozzles, a white streak may appear on a printed material.

Conventionally, if there is even one discharge failure nozzle, the use of a printhead including it is stopped. More specifically, when such a discharge failure nozzle is detected during the manufacture of a printhead, the printhead having the nozzle is discarded. If a discharge failure nozzle is generated in a printhead after the delivery of a printing apparatus to the user, he has to buy a new printhead.

This situation, that is, generation of a discharge failure nozzle in a printhead puts an economic burden on both the manufacturer and user of a printing apparatus. To make matters worse, recent printing apparatuses have an enormous number of printing nozzles. For example, when the printing apparatus can print in eight colors each using 786 nozzles, the total number of nozzles is 6,288. The increasing number of nozzles raises the probability that discharge failure nozzles are generated among the nozzles.

To avoid this, there is proposed a technique regarding so-called discharge failure complementation to complement print dot data of a discharge failure nozzle in a printhead. For example, Japanese Patent Laid-Open Nos. 2005-096424, 2005-074944, and 2005-096232 disclose techniques for implementing the discharge failure complementation by simple algorithms. These techniques perform discharge failure complementation by distributing data of a discharge failure nozzle to print dot data of nozzles near it.

However, conventional discharge failure complementation techniques suffer the following problems.

FIGS. 14A and 14B are views showing nozzle array arrangements in a printhead. FIG. 14A exemplifies the simplest printhead arrangement. In this printhead, nozzles (of at least a discharge nozzle array for a single color) discharge ink droplets of the same size. To the contrary, FIG. 14B exemplifies a printhead arrangement implemented by an advanced manufacturing technique. This printhead includes a plurality of nozzles for discharging ink droplets of different sizes even for the same color ink. In this example, nozzles for discharging ink droplets of three, large, middle, and small sizes are arranged separately.

As the printhead structure changes, conventional discharge failure complementation methods cannot be applied any more. Conventionally, all ink droplets discharged from one printhead have the same size regardless of the same or different ink colors. Thus, data of a discharge failure nozzle can be distributed to peripheral normal nozzles for the same color ink. This method, however, cannot be simply employed when nozzles for the same color ink discharge ink droplets of a plurality of sizes. For example, in an arrangement in which one printhead includes nozzles for discharging ink droplets of a plurality of sizes, the pitch between nozzles for discharging ink droplets of the same color and the same size tends to be larger than the conventional one. In this printhead arrangement, even if data of a discharge failure nozzle is distributed to peripheral normal nozzles for the same size, the interval between an original printing point and a complementary point widens. A streak or unevenness may still appear in a printing result.

That is, discharge failure complementation cannot be done appropriately in a printhead in which a plurality of nozzle arrays are arranged to discharge ink droplets of different sizes.

SUMMARY OF THE INVENTION

The present invention provides a printing apparatus and printing method for implementing discharge failure complementation in an arrangement for printing a halftone image using ink droplets of the same color but different sizes.

According to a first aspect of the present invention, there is provided a printing apparatus which prints by discharging ink droplets from a first nozzle array and a second nozzle array based on print data using a printhead including the first nozzle array and the second nozzle array for discharging ink droplets of the same color and different discharge amounts, the apparatus comprising: a specifying unit configured to specify a discharge failure nozzle in the first nozzle array and the second nozzle array; and a controller configured to assign print data corresponding to the discharge failure nozzle specified by the specifying unit to a nozzle of a nozzle array different from a nozzle array to which the discharge failure nozzle belongs, out of the first nozzle array and the second nozzle array.

According to a second aspect of the present invention, there is provided a method of printing by discharging ink droplets from a first nozzle array and a second nozzle array based on print data using a printhead including the first nozzle array and the second nozzle array for discharging ink droplets of the same color and different discharge amounts, the method comprising: specifying a discharge failure nozzle in the first nozzle array and the second nozzle array; and assigning print data corresponding to the specified discharge failure nozzle to a nozzle of a nozzle array different from a nozzle array to which the discharge failure nozzle belongs, out of the first nozzle array and the second nozzle array.

Further features of the present invention will be apparent from the following description of exemplary embodiments with reference to the attached drawings.

BRIEF DESCRIPTION OF THE DRAWINGS

FIG. 1 is a table exemplifying a transformation matrix used for rendering into print dot data corresponding to each ink droplet size;

FIGS. 4A to 4C are tables exemplifying transformation matrices used for rendering into print dot data corresponding to each ink droplet size according to the first embodiment;

FIG. 5 is a table exemplifying a look-up table according to the first embodiment;

FIG. 9 is a flowchart exemplifying the operation of the printing apparatus shown in FIG. 6;

FIG. 11 is a table exemplifying a look-up table according to the second embodiment;

DESCRIPTION OF THE EMBODIMENTS

Figure 2:
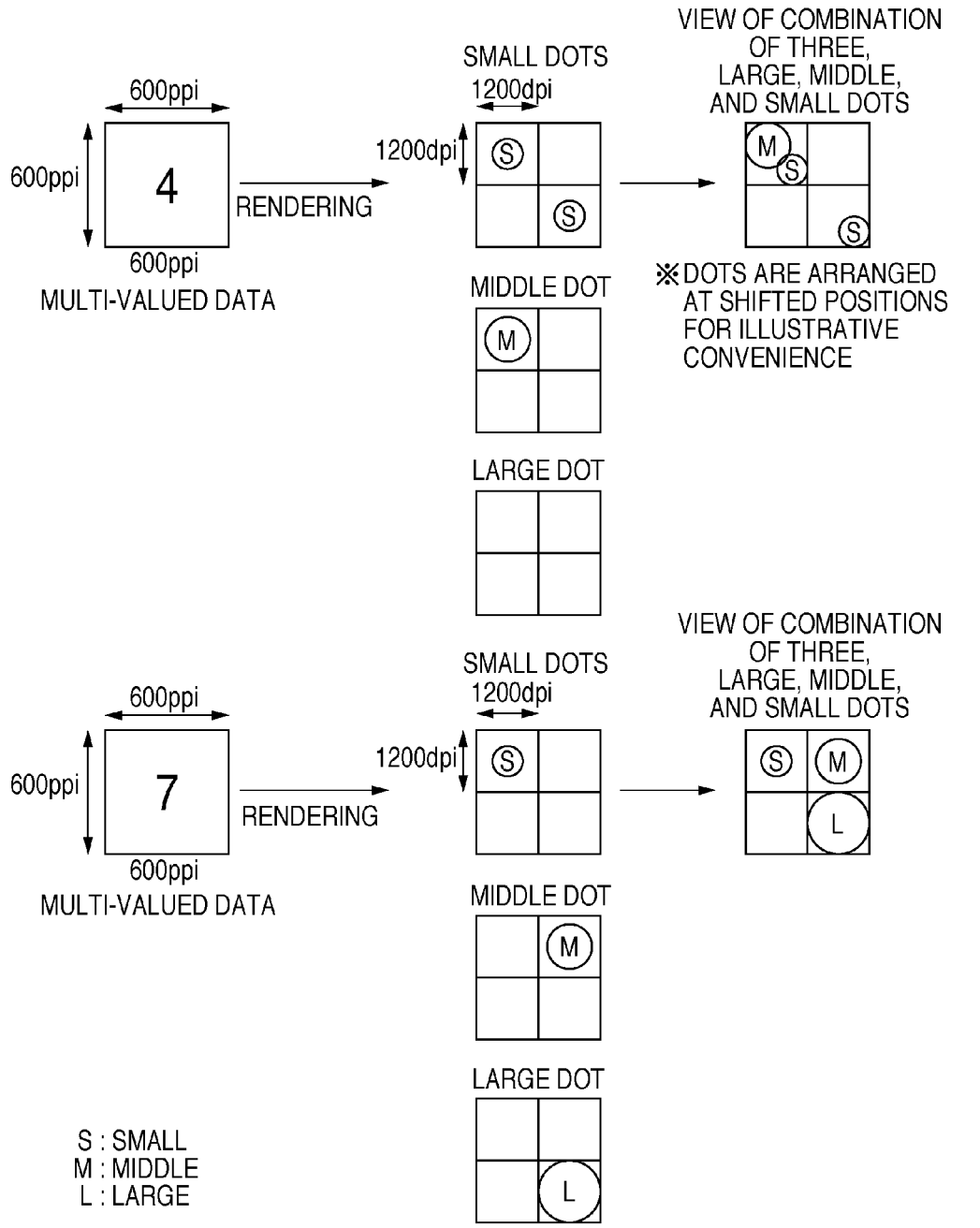
FIG. 2 is a view showing the concept of rendering into print dot data corresponding to each ink droplet size.

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Preferred embodiments of the present invention will be described in detail below with reference to the accompanying drawings. In the following description, a printing apparatus using an inkjet printing method will be exemplified. The printing apparatus using the inkjet printing method may be, for example, a single-function printer having only a print function, or a multi-function printer having a plurality of functions including a print function, FAX function, and scanner function. Also, the printing apparatus using the inkjet printing method may be a manufacturing apparatus for manufacturing a color filter, electronic device, optical device, microstructure, or the like by the inkjet printing method.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Also, a "nozzle" generically means an orifice, a liquid channel which communicates with it, and an element which generates energy used for ink discharge, unless otherwise specified.

First Embodiment

Relationship between Large-, Middle-, and Small-size Ink Droplets

There are mainly two types of data input to a printing apparatus. The first data is input from a PC (Personal Computer). In this case, the PC converts image data displayed on a display or the like into data of a printing ink color, and outputs the converted data to the printing apparatus. The second data is data (mainly in the JPEG or TIFF format) input from a digital camera, memory card, or the like. In this case, the printing apparatus needs to convert image data expressed by the RGB system into data of a printing ink color. In either case, image data must be converted into data of a printing ink color for printing.

This also applies to printing with ink droplets of the same color at three sizes. However, image data need not be created separately for ink droplets of the same color at the large, middle, and small sizes. Data of the same ink color is input as one kind of multi-valued data (engine input pixel). Immediately before printing, the printing apparatus separates and renders the multi-valued data into print dot data for the large, middle, and small sizes. This can reduce the printing memory size.

For example, the data have a relationship shown in FIG. 1. FIG. 1 exemplifies a transformation matrix used to separate multi-valued data of a given ink color into print dot data corresponding to a plurality of ink droplet sizes (large, middle, and small) for the same color. This example assumes that the resolution of multi-valued data is 600 [ppi] and that of print dot data corresponding to the large, middle, and small ink droplet sizes for the same color as that of the multi-valued data is 1,200 [ppi]. That is, each print dot data generated from one multi-valued data is rendered into a 2×2 matrix, and a halftone image is printed for each matrix.

The respective ink droplet sizes are set to $$\text{middle-size ink droplet} = 2 \times \text{small-size ink droplets}$$

$$\text{large-size ink droplet} = 2 \times \text{middle-size ink droplets} = 4 \times \text{small-size ink droplets}$$

As is apparent from FIG. 1, the difference between respective multi-valued data (e.g., difference between values #5 and #4 or difference between values #10 and #9) equals one small dot. This is merely an example, and the difference may be one middle dot (=two small dots) or the sum of one middle dot and one small dot (=three small dots). It suffices to generate a difference of a predetermined ink amount every time multi-valued data is incremented by one unit.

FIG. 2 is a conceptual view showing this rendering as an actual image on a sheet surface. As described above, this example assumes that the resolution of multi-valued data is 600 [ppi] and that of print dot data corresponding to a plurality of ink droplet sizes (large, middle, and small) for the same color as that of the multi-valued data is 1,200 [ppi]. That is, as shown in FIG. 2, each print dot data which is separated from one pixel of multi-valued data and corresponds to one of ink droplet sizes for the same color as that of the multi-valued data is rendered into four dots of a 2×2 matrix.

FIG. 2 shows rendering of multi-valued data values #4 and #7. According to the rule shown in FIG. 1, these data are rendered into value #4→two small dots, one middle dot, and no large dot value #7→one small dot, one middle dot, and one large dot A look-up table (LUT) or the like designates the layout of print dot data at the respective ink droplet sizes in a 2×2 matrix. The outline of the rendering shown in FIG. 2 is merely an example, and the rendering method is not limited to this.

(Outline of Discharge Failure Complementation for Large-, Middle-, and Small-size Ink Droplets)

Based on the foregoing technique, the concept of discharge failure complementation (complementary printing) for large-, middle-, and small-size ink droplets according to the embodiment will be explained.

As described above, the respective ink droplet sizes have relationships:

$$\text{middle-size ink droplet} = 2 \times \text{small-size ink droplets}$$

$$\text{large-size ink droplet} = 2 \times \text{middle-size ink droplets} = 4 \times \text{small-size ink droplets}$$

More specifically, ink droplets discharged from middle- and large-dot discharge nozzles are n (n is a natural number of 2 or more) times larger in volume than an ink droplet discharged from a small-dot discharge nozzle (nozzle for discharging an ink droplet of the minimum size among those of a plurality of sizes). In other words, ink droplets discharged from nozzles other than one for discharging an ink droplet of the minimum size are n (n is a natural number of 2 or more) times larger in volume than an ink droplet discharged from that nozzle. As described above, these ink droplet sizes have a difference of a predetermined ink amount (i.e., a density difference on the sheet surface) every time multi-valued data is incremented by one pixel.

Figure 3A:
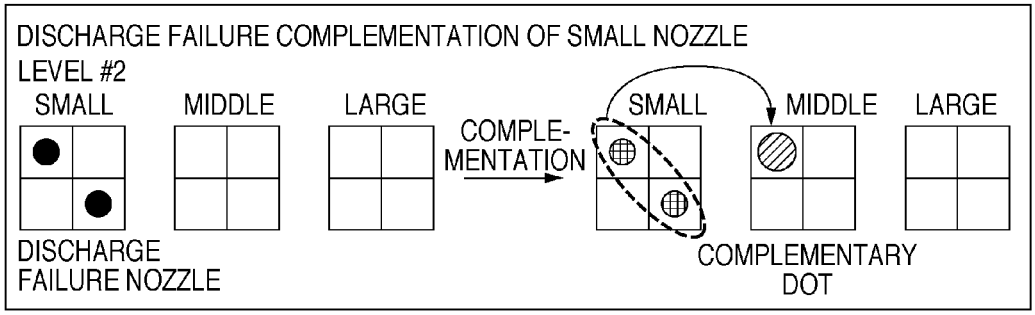
FIGS. 3A to 3D are views exemplifying the concept of discharge failure complementation processing according to the first embodiment.

Under this condition, processes shown in FIGS. 3A to 3D are established. FIG. 3A is a conceptual view showing rendering of multi-valued data value #2 into print dot data as an image on the sheet surface. According to the rule in FIG. 1, the multi-valued data results in a rendered image shown on the left side of FIG. 3A. If a small-dot discharge nozzle for this rendering fails in discharge, a rendered image shown on the right side is also theoretically usable. More specifically, the ink droplet sizes satisfy the relationships:

$$\text{middle-size ink droplet} = 2 \times \text{small-size ink droplets}$$

$$\text{large-size ink droplet} = 2 \times \text{middle-size ink droplets} = 4 \times \text{small-size ink droplets}$$

The amount of ink droplets used for printing in a 600-ppi area (1,200-dpi 2×2 area) on the sheet surface is equal between the rendered images shown on the left and right sides. For example, a dot area formed by two small-dot ink droplets equals that formed by one middle-dot ink droplet. Hence, two undischarged small-dot ink droplets can be complemented by one middle-dot ink droplet.

Figure 3B:
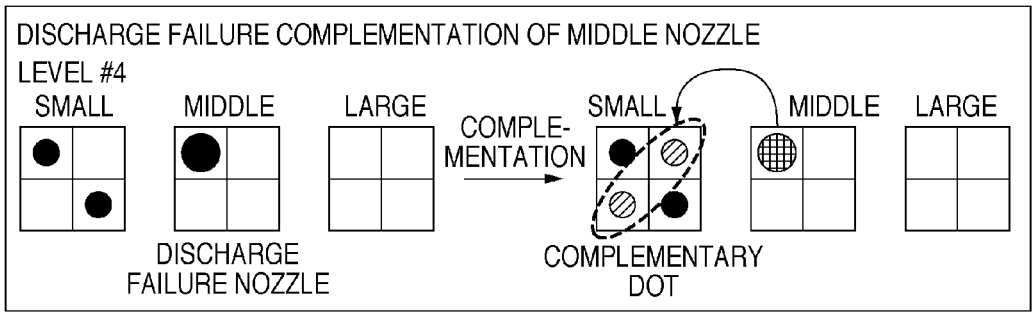
Figure 3C:
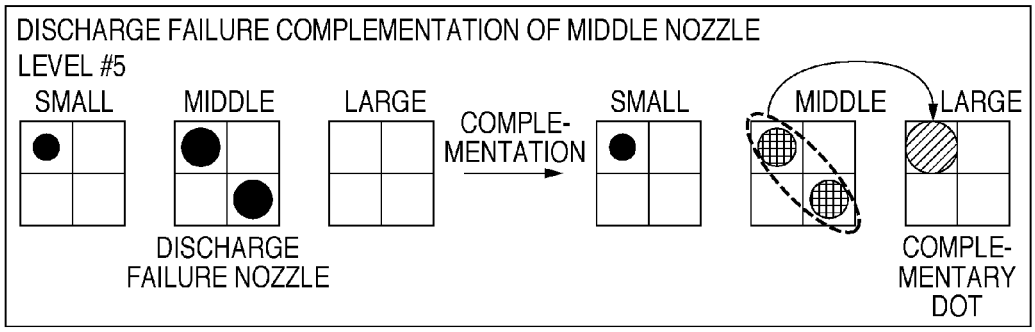

Similarly, FIGS. 3B and 3C show processes when a middle-dot discharge nozzle fails to discharge. FIG. 3B shows discharge failure complementation for multi-valued data value #4. One undischarged middle-dot ink droplet is complemented by two small-dot ink droplets. FIG. 3C shows discharge failure complementation for multi-valued data value #5. Two undischarged middle-dot ink droplets are complemented by one large-dot ink droplet.

Figure 3D:
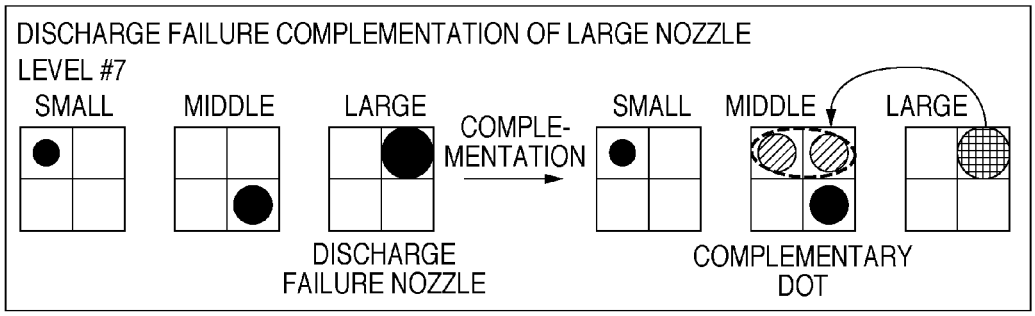

Also, FIG. 3D shows a process when a large-dot discharge nozzle fails to discharge. FIG. 3D shows discharge failure complementation for multi-valued data value #7. One undischarged large-dot ink droplet is complemented by two middle-dot ink droplets.

FIGS. 4A to 4C are tables showing dot layout matrices for complementing a discharge failure in all use cases. FIG. 4A shows a case in which a small-dot discharge nozzle fails to discharge. FIG. 4B shows a case in which a middle-dot discharge nozzle fails to discharge. FIG. 4C shows a case in which a large-dot discharge nozzle fails to discharge.

A comparison between FIGS. 4A to 4C and FIG. 1 reveals that the total ink amount (density on the sheet surface) upon printing for each multi-valued data is almost equal to an original one. More specifically, even if a nozzle for any size fails to discharge when printing a halftone image using ink droplets of a plurality of sizes by a printing apparatus which discharges ink droplets of a plurality of sizes for the same color, a low printing density can be complemented using a nozzle for another size.

In principle, this arrangement cannot complement one dot of the small size serving as the minimum granularity by an ink droplet of another size (because printing of 0.5×middle-size ink droplet or 0.25×large-size ink droplet is impossible).

A more detailed mechanism will be explained. FIG. 5 shows, as data rendering LUTs, a normal table, a table for complementing a small-dot discharge failure, a table for complementing a middle-dot discharge failure, and a table for complementing a large-dot discharge failure.

If no discharge failure nozzle exists in nozzle arrays for large-, middle-, and small-size ink droplets when printing a halftone image using these nozzle arrays, the normal table is used as the data rendering LUT. If a discharge failure nozzle exists among small nozzles in the nozzle arrays under the same condition, the table for complementing a small-dot discharge failure is used as the data rendering LUT. Similarly, if a discharge failure nozzle exists in middle nozzles, the table for complementing a middle-dot discharge failure is used as the data rendering LUT. Similarly, if a discharge failure nozzle exists in large nozzles, the table for complementing a large-dot discharge failure is used as the data rendering LUT. This arrangement can establish the above-described principle.

(Apparatus Arrangement)

The arrangement of a printing apparatus according to the embodiment of the present invention will be exemplified. This embodiment will exemplify a serial printer in which the printhead moves with respect to a printing medium to repeat scanning (main-scanning) and the printing medium moves (sub-scanning) as well. However, the printing apparatus is not limited to this and may be a line printer. In the line printer, a printing medium moves and is scanned by a stationary printhead. In either case, the printhead relatively scans a printing medium.

Figure 6:
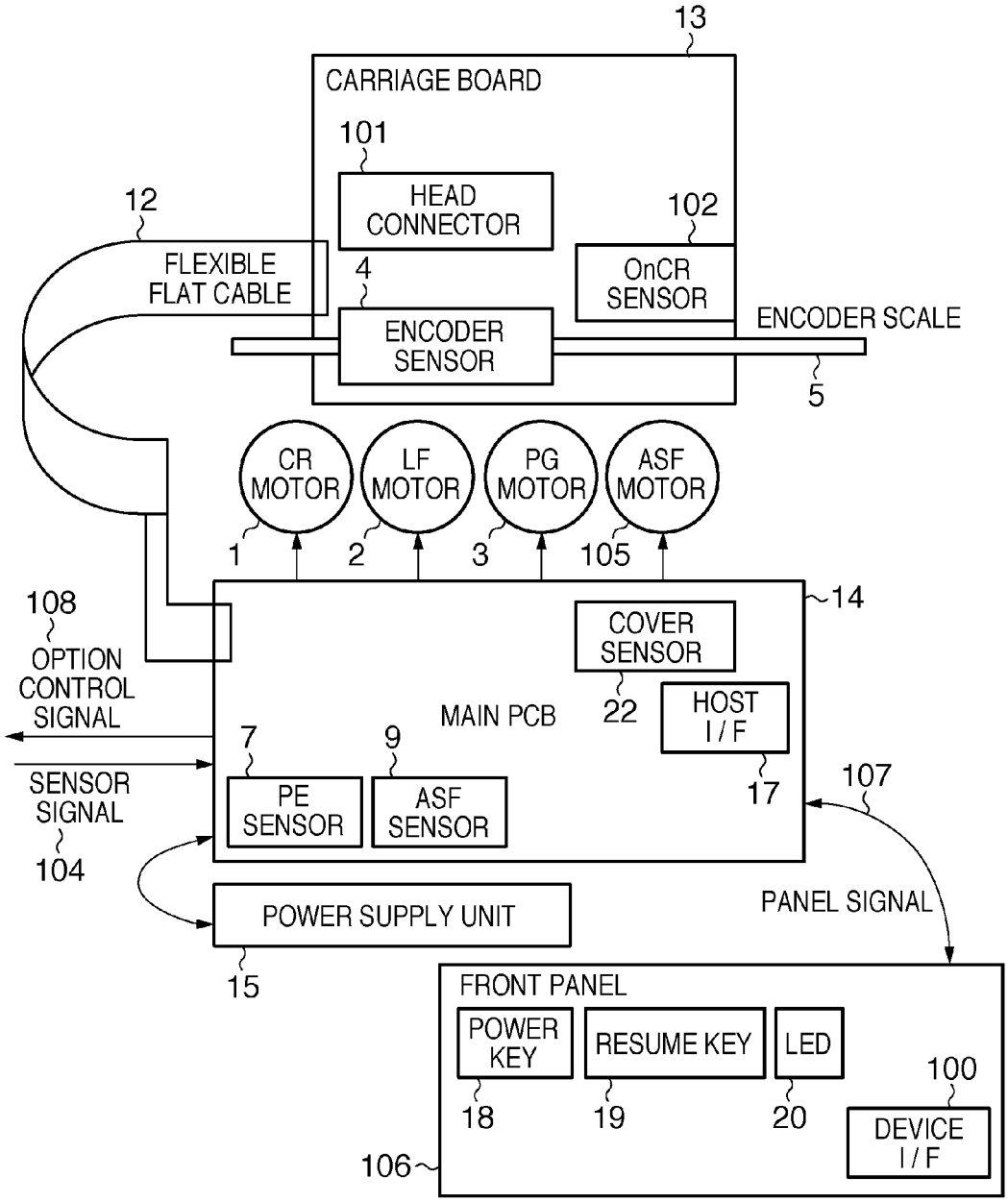
FIG. 6 is a block diagram exemplifying the overall arrangement of the electric circuit of a printing apparatus according to the first embodiment.

The overall arrangement of the electric circuit of the printing apparatus according to the embodiment will be explained with reference to FIG. 6. The electric circuit includes a carriage board (CRPCB (Printed Circuit Board)) 13, a main PCB 14, a power supply unit 15, and a front panel 106.

The power supply unit 15 is connected to the main PCB 14 and supplies various kinds of driving powers. The carriage board 13 is a printed board unit mounted on a carriage (not shown). The carriage board 13 functions as an interface for exchanging signals with a printhead (not shown) via a head connector 101. The carriage board 13 detects a change of the positional relationship between an encoder scale 5 and an encoder sensor 4, based on a pulse signal output from the encoder sensor 4 as the carriage moves. The carriage board 13 outputs the signal to the main PCB 14 via a flexible flat cable (CRFFC) 12. The carriage board 13 mounts an OnCR sensor 102. The carriage board 13 outputs ambient temperature information obtained by a thermistor and reflected light information obtained by an optical sensor to the main PCB 14 via the flexible flat cable 12 together with head temperature information obtained from the printhead.

The main PCB 14 is a controller mainly formed from an ASIC (Application Specific Integrated Circuit), and is a printed board unit which drives and controls each unit of the printing apparatus. A paper end sensor (PE sensor) 7, ASF (Automatic Sheet Feeder) sensor 9, cover sensor 22, and host interface (host I/F) 17 are mounted on the main PCB 14. The main PCB 14 is connected to a CR motor 1, LF motor 2, PG motor 3, and ASF motor 105 to drive and control these motors. The CR motor 1 functions as a driving source for driving the carriage in the main-scanning direction. The LF motor 2 functions as a driving source for conveying a printing medium. The PG motor 3 functions as a driving source for a printhead recovery operation. The ASF motor 105 functions as a driving source for a printing medium feed operation. The main PCB 14 receives sensor signals 104 which are input from switches and sensors and represent the mounting and operation states of an ink empty sensor, medium (paper) discrimination sensor, carriage position (level) sensor, LF encoder sensor, PG sensor, and various optional units. The main PCB 14 outputs an option control signal 108 for driving and controlling these optional units. The main PCB 14 additionally includes a connection interface (panel signal 107) for connecting the flexible flat cable 12, power supply unit 15, and front panel 106.

The front panel 106 is an operation unit for accepting a user operation, and is attached to, for example, the front surface of the apparatus main body. The front panel 106 includes, for example, a resume key 19, an LED 20, a power key 18, and a device I/F 100 used to connect a peripheral device such as a digital camera.

Figure 7:
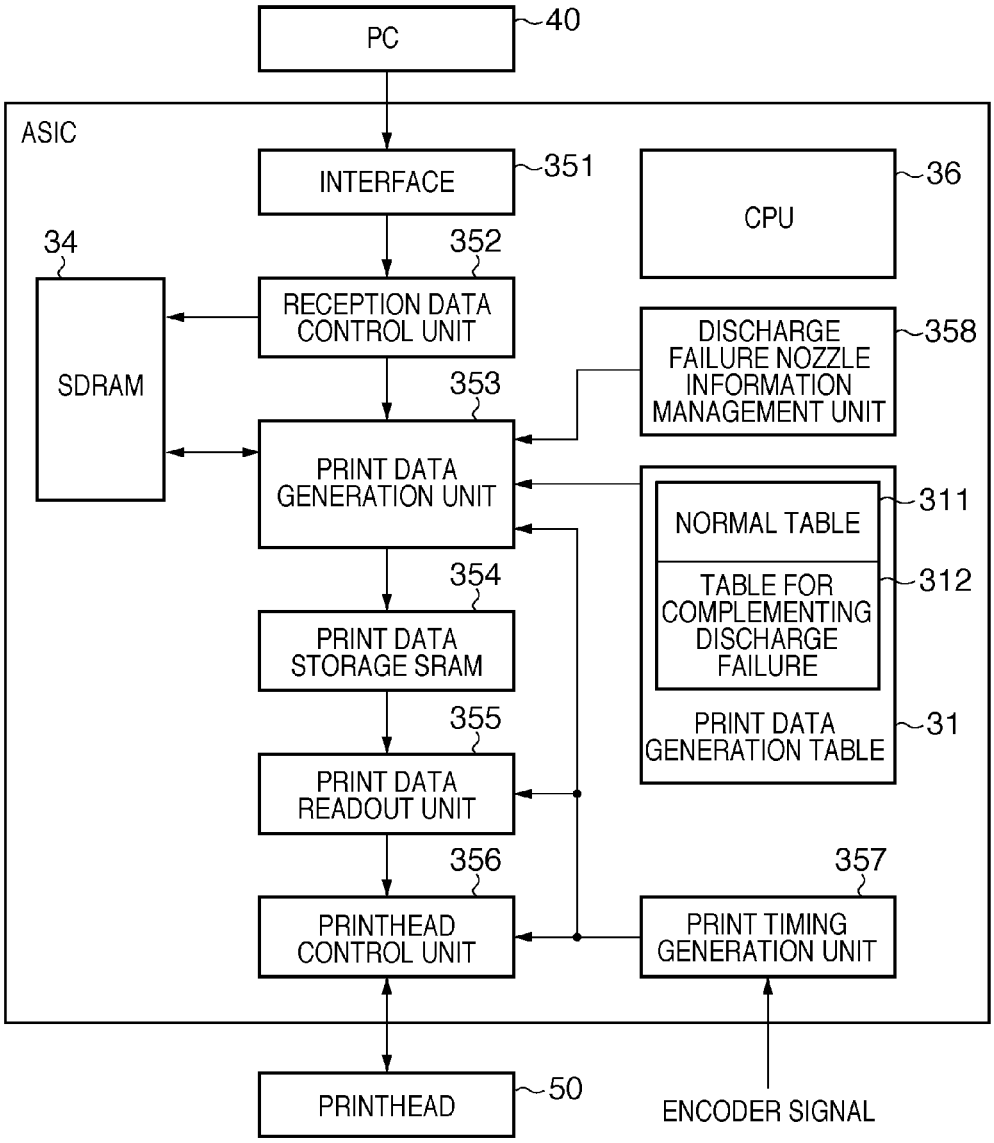
FIG. 7 is a block diagram exemplifying the arrangement of the ASIC of a main PCB 14 shown in FIG. 6.

The arrangement of the ASIC of the main PCB 14 will be exemplified with reference to FIG. 7. An arrangement concerning the discharge failure complementation function will be mainly explained. Before a description of the discharge failure complementation function, a PC 40 and printhead 50 will be explained for easy understanding of the function.

The PC 40 is an external terminal arranged outside the printing apparatus according to the embodiment. The PC 40 transmits data for printing to a wired or wireless interface of the printing apparatus.

The printhead 50 prints an image by discharging ink onto a printing medium according to the inkjet printing method. As the ink discharge method, various inkjet methods are available, including a method using a heater, one using a piezoelectric element, one using an electrostatic element, and one using a MEMS element. As described in the outline (principle), a discharge failure nozzle sometimes exists among normal nozzles in the printhead 50. The ASIC internally generates data for controlling the operation of the printhead 50, that is, print data, discharge pulse signals, and the like.

Figure 14A:
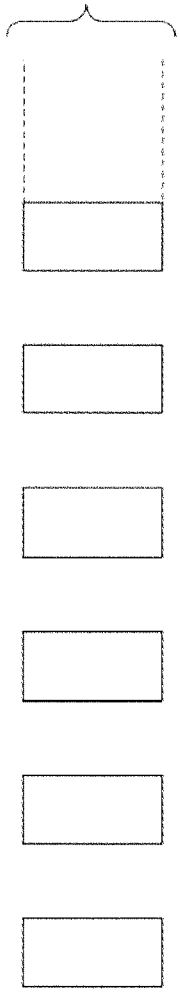
FIG. 14A PRIOR ART
FIGS. 14A and 14B are views exemplifying nozzle array arrangements in a printhead.
Figure 14B:
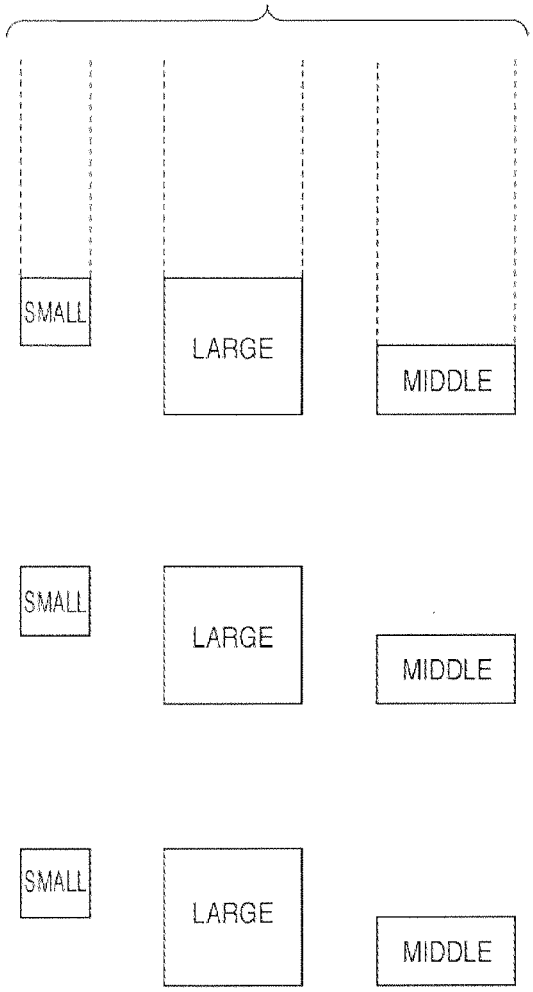

The nozzle array arrangement of the printhead 50 will be described. The printhead 50 includes a nozzle array formed from a plurality of nozzles. A plurality of nozzle arrays having the same print width are arranged in the arrayed direction of the nozzle array to discharge ink droplets of different sizes. More specifically, the printhead 50 has a plurality of nozzle arrays each made up of a plurality of nozzles, and the sizes of ink droplets discharged from the nozzle arrays differ from each other. FIG. 14B exemplifies a nozzle array arrangement corresponding to a given color ink in the printhead 50 for printing in color. This printhead has nozzles for discharging ink droplets of three sizes of 1 [pl] (small), 2 [pl] (middle), and 4 [pl] (large). A set of three nozzle arrays is arranged in the scanning direction of the printhead for each of colors (e.g., four, C, M, Y, and K).

The internal arrangement of the ASIC will be explained. A CPU 36 comprehensively manages the operation of the overall ASIC, and an SDRAM 34 serves as a main memory. The main memory need not always be an SDRAM, and may be a DRAM or SRAM as long as the memory falls in the category of RAMs.

The remaining building components of the ASIC are so-called random logic, and implement an operation unique to the printing apparatus and the discharge failure complementation function according to the embodiment. The random logic will be explained.

An interface 351 receives data from the PC 40. The interface 351 receives a signal complying with an interface protocol such as a USB protocol or IEEE1394 protocol, and generates data easy to handle by the ASIC (e.g., formats data into 1-byte data). Data input to the ASIC via the interface 351 is sent to a reception data control unit 352. The reception data control unit 352 receives the data received by the interface 351 and saves it in the SDRAM 34.

The data stored in the SDRAM 34 by the reception data control unit 352 is read out to a print data generation unit 353 in synchronism with each print control timing, generating print dot data. The print data generation unit 353 functions as an H-V converter, multi-valued data rendering unit, multipass/mask controller, and the like. These functions access the SDRAM 34 and execute their specific data processes.

When rendering multi-valued data, the print data generation unit 353 uses a print data generation table 31. The print data generation table 31 includes a normal table 311 and a table 312 for complementing a discharge failure, as described with reference to FIG. 5.

A discharge failure nozzle information management unit 358 manages information (e.g., color, ink droplet size, and a position among nozzles) on a discharge failure nozzle. The normal table 311, the table 312 for complementing a discharge failure, and the discharge failure nozzle information management unit 358 are implemented in, for example, a register readable/rewritable by the CPU 36. In some cases (for example, when the table information amount is very large), the normal table 311, table 312, and discharge failure nozzle information management unit 358 may be implemented in a small-scale SRAM. The CPU 36 can access the discharge failure nozzle information management unit 358 to specify a discharge failure nozzle based on the stored information. Note that information on a discharge failure nozzle is detected in advance and stored in the discharge failure nozzle information management unit 358. As the discharge failure nozzle detection method, a variety of methods are known, including a method of discharging ink from a nozzle, detecting it using a sensor, and determining whether the nozzle normally discharged ink or failed in discharge. Hence, a detailed description of the method will be omitted.

Print dot data generated by the print data generation unit 353 is stored in a print data storage SRAM 354. The print dot data stored in the print data storage SRAM 354 is in a format printable immediately after sent to a printhead control unit 356. That is, data having undergone multipass processing, multi-valued data rendering, mask processing, discharge failure complementation processing, and the like is stored as print dot data in the print data storage SRAM 354. Note that the print data storage SRAM 354 is not an essential building component and may be omitted.

A print data readout unit 355 reads out print dot data stored in the print data storage SRAM 354. The print data readout unit 355 sends the readout print dot data to the printhead control unit 356.

The printhead control unit 356 controls a print operation by the printhead by scanning the printhead 50 relatively to a printing medium. For example, the printhead control unit 356 transfers print dot data received from the print data readout unit 355 to the printhead 50 or transmits a heat pulse signal to the printhead 50.

A print timing generation unit 357 generates various print timings based on an encoder signal from the encoder sensor 4. Based on the encoder signal, the print timing generation unit 357 generates an axis signal (X-coordinate) representing the position of the printhead at an appropriate interval. In synchronism with the coordinate axis information, the print timing generation unit 357 transmits a print request for each nozzle array in the printhead (information representing whether to print on the X-coordinate axis where the printhead is positioned now). Destinations of the print request are the print data generation unit 353, print data readout unit 355, and printhead control unit 356. In this way, these building components can transfer data at proper timings.

Figure 8:
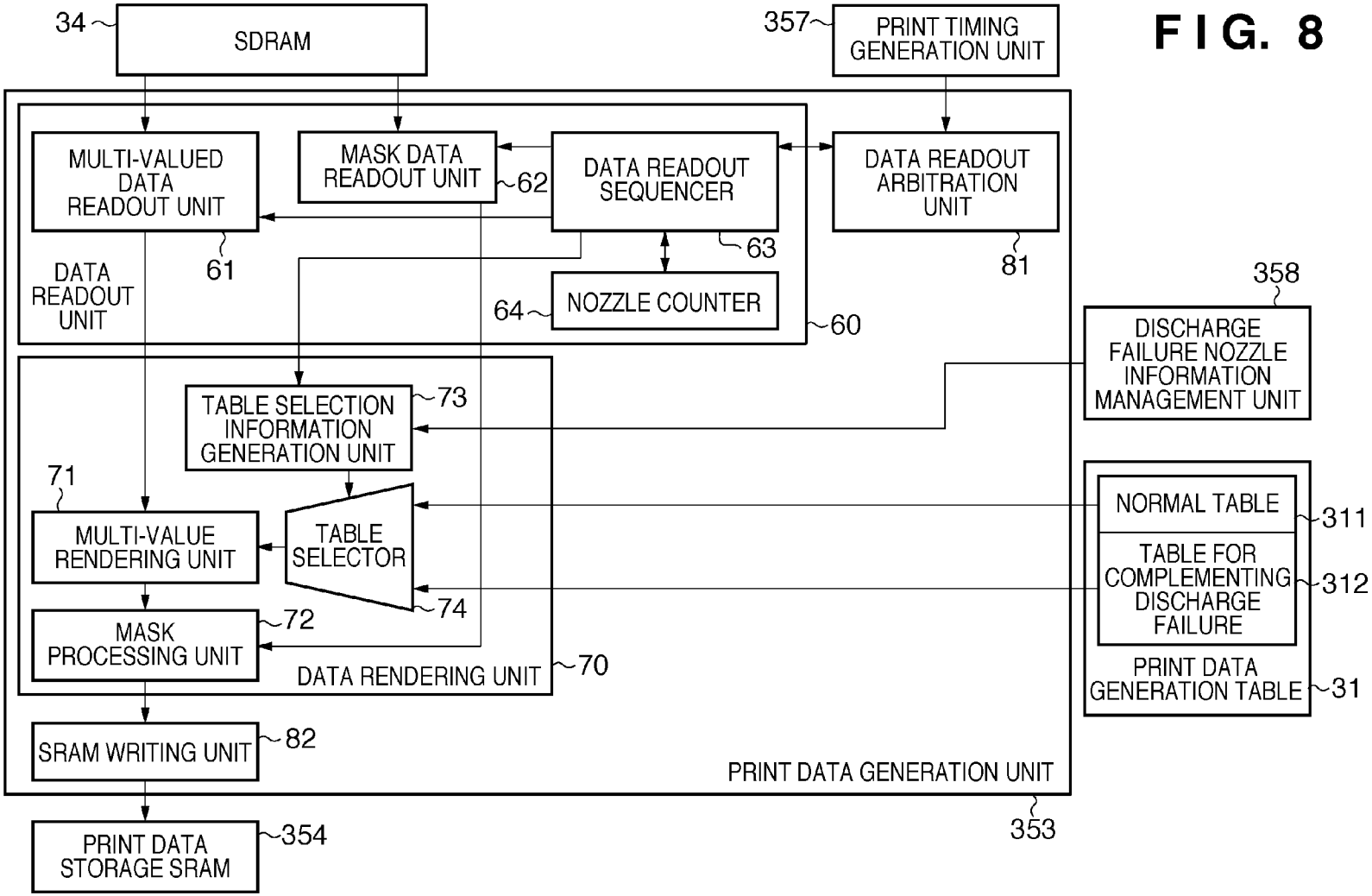
FIG. 8 is a block diagram exemplifying the arrangement of a print data generation unit 353 shown in FIG. 7.

The arrangement of the print data generation unit 353 shown in FIG. 7 will be exemplified with reference to FIG. 8. A data readout arbitration unit 81 receives a signal (print request) from the print timing generation unit 357 and arbitrates it. As described above, the print timing generation unit 357 generates an axis signal (X-coordinate) at an appropriate interval from an encoder signal, and transmits a print request for each nozzle array in the printhead in synchronism with the coordinate axis information. Print requests are often issued simultaneously for a plurality of nozzle arrays on a given X-coordinate position (e.g., in order to simultaneously discharge cyan and magenta inks). In this case, the data readout arbitration unit 81 arbitrates these requests, and determines which nozzle array print request is appropriate for data rendering.

After determining a nozzle array print request to be used for data rendering, the data readout arbitration unit 81 transmits nozzle array information necessary to be rendered to a data readout sequencer 63 in a data readout unit 60, together with the print request.

In response to the print request, the data readout sequencer 63 activates DMA for a multi-valued data readout unit 61 and mask data readout unit 62 in the data readout unit 60. Depending on a print mode, no mask processing may be done. In this case, the data readout sequencer 63 does not activate DMA for the mask data readout unit 62.

The numbers of multi-valued data readout operations and mask data readout operations necessary for one print request depend on the nozzle length (the number of nozzle orifices in one nozzle array) of a nozzle array corresponding to the print request. Thus, the data readout unit 60 includes a nozzle counter 64 for managing the DMA activation count (which can also be referred to as a DMA counter in this case). With the nozzle counter 64, the data readout unit 60 can grasp a nozzle (to be referred to as a "nozzle number") whose multi-valued data is currently processed in the nozzle array corresponding to the print request.

The data readout unit 60 sends, to a data rendering unit 70, the readout multi-valued data, mask data, and information on a nozzle array and a nozzle number in the nozzle array. The multi-valued data from the multi-valued data readout unit 61 is transferred to a multi-value rendering unit 71 in the data rendering unit 70.

The multi-value rendering unit 71 renders the multi-valued data into print dot data corresponding to the size of an ink droplet to be discharged from a target nozzle array. More specifically, the multi-value rendering unit 71 receives an LUT used for rendering into print dot data corresponding to the size of an ink droplet to be discharged from a nozzle array corresponding to the print request. Based on the contents of the LUT, the multi-value rendering unit 71 renders the multi-valued data.

A table selection information generation unit 73 transfers, to the multi-value rendering unit 71, an LUT used for rendering into print dot data. The table selection information generation unit 73 provides the LUT to the multi-value rendering unit 71 by transmitting, to the multi-value rendering unit 71, information which designates the type of LUT used for data rendering. More specifically, the table selection information generation unit 73 executes the following processes.

1. The table selection information generation unit 73 selects an LUT corresponding to the ID of a nozzle array whose data is to be rendered. Basically, the table selection information generation unit 73 uses different data rendering LUTs for respective nozzle arrays. Note that the table selection information generation unit 73 receives nozzle array ID information from the data readout sequencer 63.

2. When a discharge failure nozzle exists in a nozzle array which shares multi-valued data to be rendered with a nozzle array whose data is to be rendered, the table selection information generation unit 73 selects a table for complementing a discharge failure in correspondence with the nozzle array ID. For example, a discharge failure nozzle exists in a middle-nozzle array, and multi-valued data of a large-nozzle array which shares data with the middle-nozzle array is to be rendered (see FIG. 5). Basically, different data rendering LUTs are used for respective nozzle arrays and respective target discharge failure nozzles (large, middle, and small discharge failure nozzles). The presence/absence and position of a discharge failure nozzle are determined by comparing nozzle position information from the data readout sequencer 63 with discharge failure nozzle information from the discharge failure nozzle information management unit 358. Note that the nozzle position information represents a discharge failure nozzle in a nozzle array specified by the ID.

3. Print data rendering processing when a discharge failure nozzle exists in a nozzle array whose data is to be rendered is not particularly defined. For example, print dot data "0" (nothing is printed) may be created.

This mechanism will be further described. The table selection information generation unit 73 transmits, to a table selector 74, all LUTs from the normal table 311 and the table 312 for complementing a discharge failure in the print data generation table 31. The table selector 74 then selects a table based on table selection information from the table selection information generation unit 73. The table selector 74 transmits the selected data rendering LUT to the multi-value rendering unit 71. By using the data rendering LUT selected by the table selection information generation unit 73, the multi-value rendering unit 71 renders multi-valued data from the multi-valued data readout unit 61 into print dot data corresponding to each ink droplet size. The multi-value rendering unit 71 sends the obtained print dot data to a mask processing unit 72.

The mask processing unit 72 composites print dot data corresponding to each ink droplet size and mask data from the mask data readout unit 62, and performs mask processing. The mask processing unit 72 outputs data to be actually used by the printhead for discharge. The mask processing unit 72 transfers the generated data to an SRAM writing unit 82. The SRAM writing unit 82 writes the data in the print data storage SRAM 354.

(Operation of Discharge Failure Complementation Processing)

The operation sequence of the printing apparatus will be exemplified with reference to the flowchart of FIG. 9. An operation when performing discharge failure complementation processing in the arrangement shown in FIG. 8 will be explained.

In the printing apparatus, the print data generation unit 353 waits until the print timing generation unit 357 issues a print request to each nozzle array (NO in S101). If the print timing generation unit 357 issues a print request to a specific nozzle array (or a plurality of specific nozzle arrays at once) (YES in S101), it sends the request to the data readout arbitration unit 81. The data readout arbitration unit 81 determines whether to perform print data rendering processing, and if the processing is to be performed, which nozzle array undergoes it. Based on the determination result, the data readout arbitration unit 81 decides a nozzle array to undergo rendering (i.e., discharge) (S102).

After deciding the nozzle array to undergo rendering, the data readout arbitration unit 81 sends the information to the data readout sequencer 63 in the data readout unit 60. Then, the data readout sequencer 63 sets a specified count corresponding to the nozzle length of the target nozzle array. The processes in S103 to S112 are repetitively executed until the process count reaches the specified one (as long as NO in S103). If the process count reaches the specified one (YES in S103), the printing apparatus returns to the standby state in S101 again.

In the printing apparatus, DMA of multi-valued data and that of mask data are activated (S104), and multi-valued data and mask data are read out (S105). If no mask processing is executed, only DMA of multi-valued data is activated.

After activating these DMAs, the readout multi-valued data and mask data are transferred to the data rendering unit 70 to activate print data rendering processing (S106).

After the start of this processing, the table selection information generation unit 73 receives nozzle array ID information from the data readout sequencer 63, nozzle position information representing a nozzle for discharging ink in the nozzle array, and discharge failure nozzle information from the discharge failure nozzle information management unit 358. Based on these pieces of information, the table selection information generation unit 73 determines whether a discharge failure nozzle exists in the nozzle array to undergo rendering and a nozzle array for a different size that prints a halftone image together with the nozzle array. As described above, the discharge failure nozzle information management unit 358 acquires and stores information on a discharge failure nozzle in advance.

If the table selection information generation unit 73 determines that there is a discharge failure nozzle (YES in S107), it transmits a signal to the table selector 74 to select the table 312 for complementing a discharge failure (S108). If the table selection information generation unit 73 determines that there is no discharge failure nozzle (NO in S107), it transmits a signal to the table selector 74 to select the normal table 311 (S109). By using the data rendering LUT selected by the table selection information generation unit 73, the multi-value rendering unit 71 renders multi-valued data from the multi-valued data readout unit 61 into print dot data corresponding to each ink droplet size (S110). More specifically, the multi-value rendering unit 71 renders multi-valued data into print dot data for each matrix so that an ink droplet corresponding to the area of a dot formed by discharging an ink droplet from the discharge failure nozzle is discharged from a normal nozzle different in size from the discharge failure nozzle in the 2×2 matrix.

When performing mask processing after data rendering, the mask processing unit 72 composites print dot data corresponding to each ink droplet size and mask data from the mask data readout unit 62, and performs mask processing (S111). The mask processing unit 72 transfers the data obtained by mask processing to the SRAM writing unit 82. The SRAM writing unit 82 writes the data in the print data storage SRAM 354 (S112). As described above, the processes in S103 to S112 are repeated by the number of times corresponding to the nozzle length of the nozzle array to undergo rendering. Thus, after the end of processing in S112, the process returns to S103 again. After performing discharge failure complementation processing by these procedures, the main PCB 14 in the printing apparatus controls discharge of ink droplets from the nozzles of the printhead based on the rendered print dot data, printing on a printing medium.

As described above, according to the first embodiment, even if a discharge failure nozzle exists among nozzles for a given size, a low printing density is compensated for using a nozzle arranged at a position corresponding to the discharge failure nozzle in a nozzle array for discharging ink droplets of a size different from that of a nozzle array to which the discharge failure nozzle belongs. Discharge failure complementation can therefore be implemented in the printing apparatus which prints a halftone image using ink droplets of different sizes for the same color. That is, discharge failure complementation can be achieved even by a printhead in which a plurality of nozzle arrays each made up of a plurality of nozzles are arrayed and discharge ink droplets of different sizes, thereby improving the printing quality of the printhead.

Second Embodiment

The first embodiment cannot complement one dot of the small size serving as the minimum granularity by an ink droplet of another size (because printing of 0.5×middle-size ink droplet or 0.25×large-size ink droplet is impossible). In contrast, the second embodiment will explain a case in which one dot of the minimum size can be complemented.

(Outline of Discharge Failure Complementation for Large-, Middle-, and Small-size Ink Droplets)

Figure 10A:
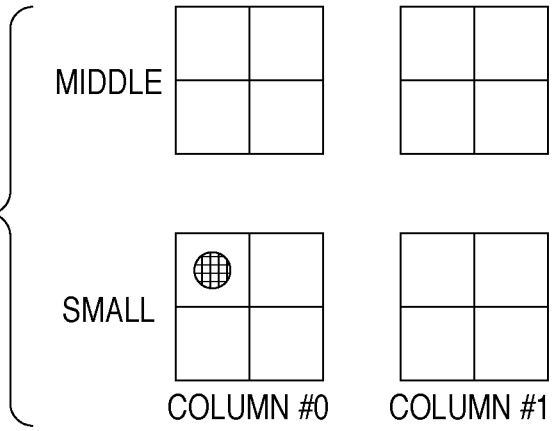
FIGS. 10A to 10C are views showing the concept of discharge failure complementation processing according to the second embodiment.
Figure 10B:
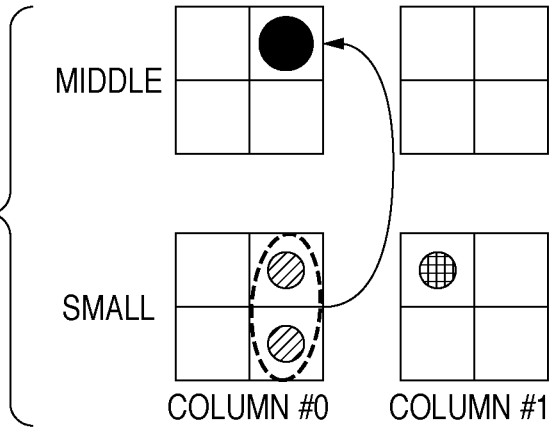
Figure 10C:
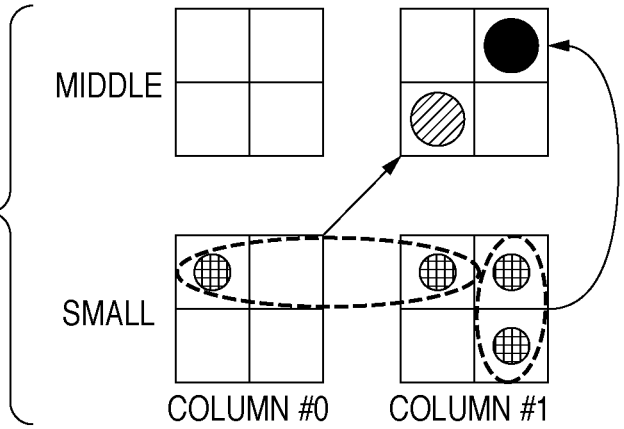

FIGS. 10A to 10C are views showing the concept of discharge failure complementation processing according to the second embodiment. The following rules are made to control how to complement a discharge failure of one dot of the small size serving as the minimum granularity. The discharge failure is solved by a basic method of evaluating multi-valued data of every two columns (two pixels) for only small-size dots. The column means a unit matrix formed from a plurality of dots (2×2 dots). The tone of one pixel is represented using the matrix. When multi-valued data of every two columns (first and second pixels) successive in the printhead scanning direction are observed for only small-size dots, they can be classified into four patterns:

1. an even number of small-size dots for column #0 (first pixel) and an even number of small-size dots for column #1 (second pixel) (the sum for the two columns is even), 2. an odd number of small-size dots for column #0 (first pixel) and an even number of small-size dots for column #1 (second pixel) (the sum for the two columns is odd) (FIG. 10A), 3. an even number of small-size dots for column #0 (first pixel) and an odd number of small-size dots for column #1 (second pixel) (the sum for the two columns is odd) (FIG. 10B), and 4. an odd number of small-size dots for column #0 (first pixel) and an odd number of small-size dots for column #1 (second pixel) (the sum for the two columns is even) (FIG. 10C).

For patterns "2" and "3", perfect discharge failure complementation is impossible. More specifically, for pattern "2", column #0 cannot be complemented. For pattern "3", column #0 can be complemented with a middle-size dot but column #1 cannot be complemented, as shown in FIG. 10B.

To the contrary, for patterns "1" and "4", perfect discharge failure complementation is possible. More specifically, small-size dots are observed for a plurality of matrices (two columns in this case) successive in the printhead scanning direction. If the sum of small dots in these columns is even, discharge failure complementation of small-size discharge nozzles can be performed. For pattern "1", discharge failure complementation suffices to be done for each column by the method of the first embodiment. For pattern "4", the number of small-size dots for each of two columns is odd, so the sum is even. In this case, undischarged small-size dots of the two columns are complemented at once by middle-size dots in the latter column (column #1), as shown in FIG. 10C.

This method is to halve the resolution of multi-valued data (e.g., convert 600-ppi multi-valued data into 300-ppi one) and complement undischarged dots so as to maintain the ink amount. In other words, the first embodiment has described an example of performing discharge failure complementation without changing the resolution of multi-valued data.

In this way, the second embodiment decreases the number of uncomplemented small-size dots as compared to the first embodiment because 1. the first embodiment can cope with only pattern "1", and 2. the second embodiment can cope with patterns "1" and "4".

A more detailed mechanism will be explained with reference to FIG. 11. FIG. 11 is a table corresponding to FIG. 5 described in the first embodiment. Only discharge failure complementation of small-size dots will be examined here, and that of middle- and large-size dots will not be mentioned. Discharge failure complementation of middle- and large-size dots suffices to be executed similarly to FIG. 5.

The input resolution of multi-valued data is observed at ½.

1. For multi-valued data of the first column, discharge failure complementation is executed using table "middle #0" in a table shown in FIG. 11 for complementing a small-dot discharge failure.

2. Multi-valued data of the next column follows the following rules:

(a) if the number of small dots contained in multi-valued data of the first or second column is even, discharge failure complementation is done using table "middle #0" as well, and (b) if the number of small dots contained in multi-valued data of the first and second columns is odd, discharge failure complementation is done using table "middle #1".

According to the second embodiment, if it is determined that a nozzle for discharging an ink droplet of the minimum size among ink droplets of different sizes is a discharge failure nozzle, the following processing is executed to perform complementary printing for an ink droplet of the minimum size. More specifically, rendering into print dot data corresponding to a minimum-size ink droplet is done for a plurality of matrices successive in the printhead scanning direction. The processing differs between a case in which the sum of dots formed by discharging minimum-size ink droplets in successive matrices is even and a case in which the sum is odd. When the sum is even, rendering into dot data in successive matrices is performed so that ink droplets corresponding to the area of dots formed by discharging the even number of minimum-size ink droplets are discharged from nozzles for discharging larger-size ink droplets.

Note that the second embodiment executes discharge failure complementation for an even number of small-dot ink droplets because the volume of a middle-dot ink droplet is double (even multiple) the volume of a small-dot ink droplet. If the volume of a middle-dot ink droplet is an odd multiple of that of a small-dot ink droplet, discharge failure complementation is performed for an odd number of small-dot ink droplets. In short, a discharge failure nozzle suffices to be complemented by a nozzle larger in dot size than the discharge failure nozzle so that the area of a dot to be formed by the discharge failure nozzle is maintained in a plurality of matrices.

(Apparatus Arrangement)

The arrangement of a printing apparatus according to the second embodiment will be exemplified. The arrangements of electric circuits are the same as those in FIGS. 6 and 7 of the first embodiment, and a description thereof will not be repeated.

The arrangement of a print data generation unit 353 according to the second embodiment will be described with reference to FIG. 12. The same reference numerals as those in FIG. 8 of the first embodiment denote parts having the same functions.

A data rendering unit 70 according to the second embodiment includes a data observation unit 75. The data observation unit 75 observes multi-valued data input to a multi-value rendering unit 71. The data observation unit 75 then outputs a selection signal for designating, for example, "middle #0" or "middle #1" to be used in the table for complementing a small-dot discharge failure in print data rendering processing.

Figure 12:
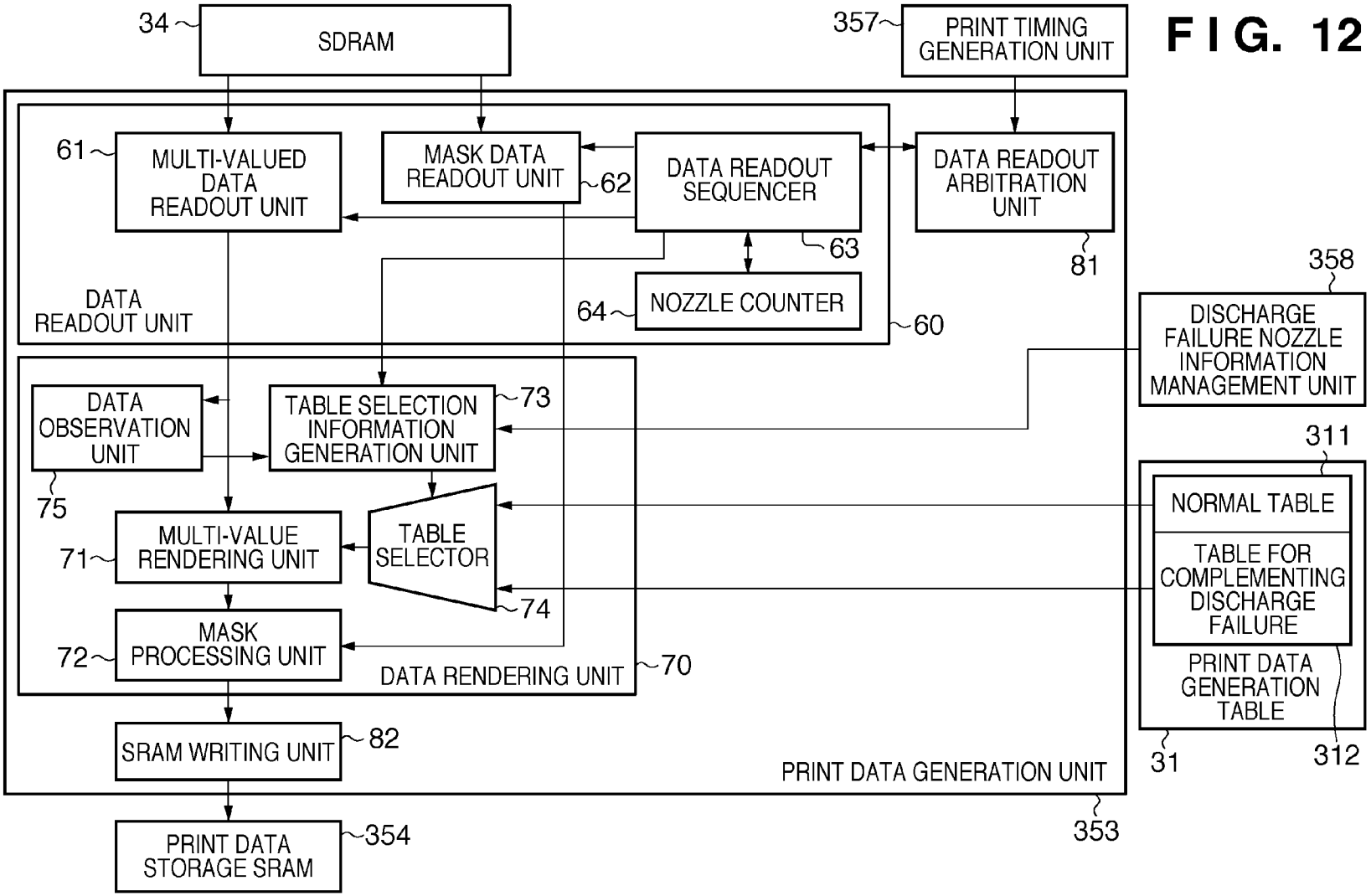
FIG. 12 is a block diagram exemplifying the arrangement of a print data generation unit 353 according to the second embodiment.
Figure 13:
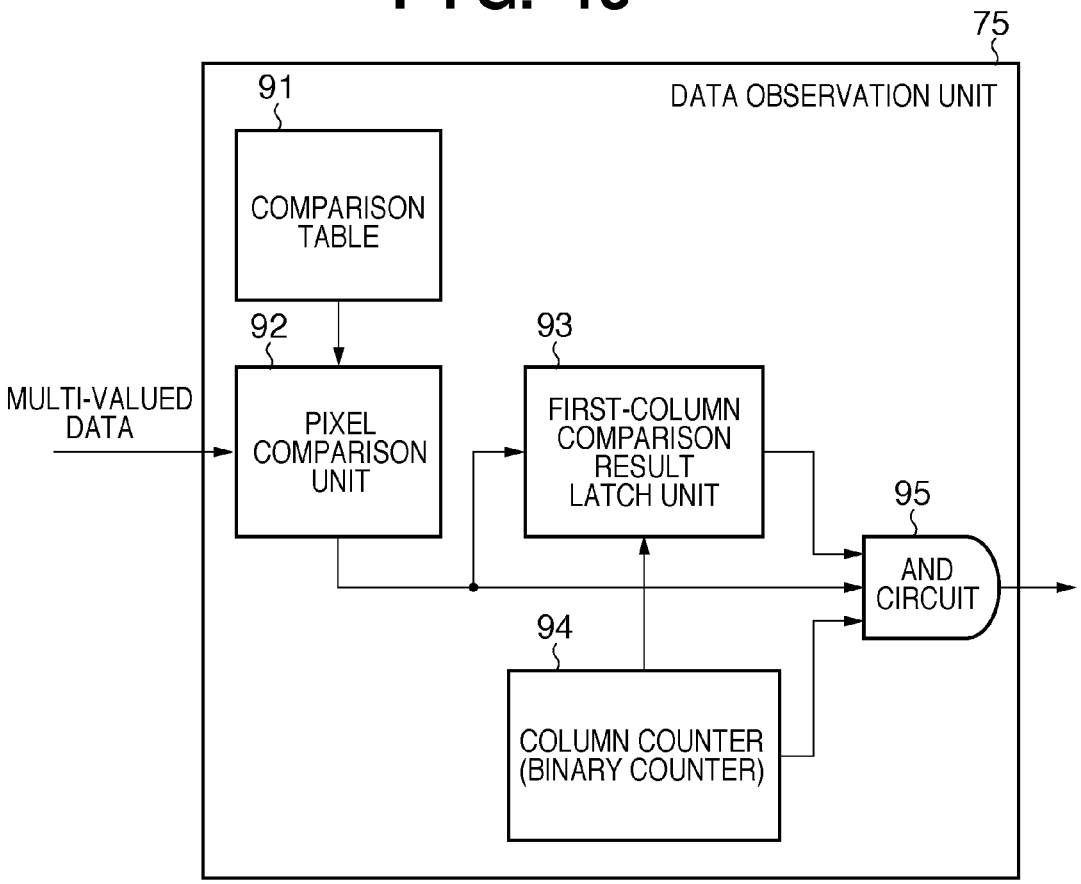
FIG. 13 is a block diagram exemplifying the arrangement of a data observation unit 75 shown in FIG. 12.

FIG. 13 is a block diagram exemplifying the arrangement of the data observation unit 75 shown in FIG. 12. A pixel comparison unit 92 observes multi-valued data and determines whether the number of small-size dots contained in multi-valued data to be rendered is odd or even. In this determination, the pixel comparison unit 92 uses a comparison table 91. The comparison table 91 holds information representing whether the number of small-size dots contained in each multi-valued data is odd or even. The comparison table 91 is implemented in, for example, a register. This processing may be assembled into a logic circuit when performing it by making a simple rule that the number of small-size dots is even when the value of each multi-valued data (engine input pixel) is even, and odd when the value is odd, as shown in FIG. 11.

A column counter 94 counts pixel columns in currently rendered multi-valued data. The column counter 94 is formed from, for example, a binary counter. The column counter 94 suffices to discriminate column #0 or #1 shown in FIGS. 10A to 10C.

A first-column comparison result latch unit 93 latches the output result (whether the number of small-size dots is odd or even) of the pixel comparison unit 92 when an output from the column counter 94 represents column #0. An AND circuit 95 ANDs the output results of the pixel comparison unit 92, column counter 94, and first-column comparison result latch unit 93.

(Operation of Discharge Failure Complementation Processing)

The operation of the printing apparatus according to the second embodiment will be exemplified. A discharge failure complementation operation in the printing apparatus according to the second embodiment is the same as that in FIG. 9 of the first embodiment. A difference will be mainly explained with reference to FIG. 9. The operation in the second embodiment is different in processing of S107 shown in FIG. 9. The processing in S107 changes depending on the output value of the column counter 94.

When the output value of the column counter 94 represents column #0, the pixel comparison unit 92 observes multi-valued data and determines whether the number of small-size dots contained in multi-valued data to be rendered is odd or even. The first-column comparison result latch unit 93 latches the determination result. The data observation unit 75 outputs a signal which designates to select a normal table ("middle #0" in the table shown in FIG. 11) for complementing a small-dot discharge failure.

When the output value of the column counter 94 represents column #1, the pixel comparison unit 92 observes multi-valued data and determines whether the number of small-size dots contained in multi-valued data to be rendered is odd or even. If both the determination result and the result of the first-column comparison result latch unit 93 indicate "the number of small-size dots is odd", the data observation unit 75 outputs a signal which designates to select not the normal table but a table ("middle #1" in the table shown in FIG. 11) for complementing a small-dot discharge failure. In any other case, the data observation unit 75 outputs a signal which designates to select the normal table ("middle #0" in the table shown in FIG. 11) for complementing a small-dot discharge failure.

As described above, the second embodiment can achieve discharge failure complementation for a nozzle for discharging a small-size ink droplet (minimum-size ink droplet), unlike the first embodiment.

Typical embodiments of the present invention have been exemplified. However, the present invention is not limited to the embodiments described above with reference to the accompanying drawings, and can be properly modified without departing from the spirit and scope of the invention.

For example, in the first and second embodiments, three, large, middle, and small ink droplet sizes have been exemplified, but the ink droplet sizes are not limited to them. The design items described with reference to FIG. 1 are important, and the number of ink droplet sizes is arbitrary as long as ink droplet sizes can be recombined to obtain the same density as that of the final result (as long as complementation is possible by another ink droplet size). For example, only two, large and small sizes, or four or more sizes are applicable. In addition, the volume ratio of large- and middle-size ink droplets and that of middle- and small-size ink droplets are not limited to double and suffice to be n times (n is a natural number of 2 or more). Further, the matrix is not limited to 2×2 dots and may be formed from a larger number of dots.

In the foregoing embodiments, when the volume of an ink droplet becomes n times larger, the dot size (diameter) also becomes n times larger. However, the relationship between ink droplet volumes and that between dot sizes may be different from each other. Since the printing density on the sheet surface is mostly determined by an area covered by dots, discharge failure complementation is preferably performed to keep the dot area unchanged from that in a normal state. Even in a printing apparatus capable of printing large, middle, and small dots, the respective dots areas may not have a relationship of integer multiples. Even in this case, the embodiments perform discharge failure complementation by distributing data to nozzles different from a discharge failure nozzle to minimize a change of the dot area from that in a normal state.

In the first and second embodiments, it is determined whether a nozzle is a normal one (capable of discharge) or a discharge failure one. If the nozzle is a discharge failure one, rendering is done using a table for complementing a discharge failure. In this arrangement, print dot data is not assigned to the discharge failure nozzle (or print dot data "0" is assigned in some cases), and data corresponding to the print dot data is distributed to other normal nozzles. However, this arrangement need not always be employed. For example, if a discharge failure nozzle exists after performing rendering into print dot data using the normal table 311 uniformly regardless of whether the nozzle is a discharge failure one or normal one, the rendering may be executed again using the table for complementing a discharge failure. That is, print dot data for performing complementary printing is assigned to a normal nozzle, and print dot data is assigned to a discharge failure nozzle, too. In this case, print dot data is assigned to even a discharge failure nozzle, but no problem occurs because the discharge failure nozzle does not discharge an ink droplet.

According to the present invention, even if a nozzle for a given size fails in discharge in an arrangement which prints a halftone image using ink droplets of different sizes for the same color, printing is done using a nozzle for another size arranged at a corresponding position. Discharge failure complementation can be achieved, improving the printing quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image processing apparatus which performs an image processing for printing an image by discharging an ink droplet on a printing medium with a first nozzle for discharging a first ink droplet, a second nozzle for discharging a second ink droplet which is larger than the first ink droplet, and a third nozzle for discharging a third ink droplet which is larger than the second ink droplet, the second ink droplet being discharged on a pixel subjected to the first nozzle, and the third ink droplet being discharged on a pixel subjected to the first nozzle or the second nozzle, the apparatus comprising:

a determination unit configured to determine a) whether or not the first nozzle is a discharge failure nozzle in which a state of discharging is not normal, b) whether or not the second nozzle is the discharge failure nozzle, and c) whether or not the third nozzle is the discharge failure nozzle; and a conversion unit configured to convert multi-valued data to binary data based on a table selected from a plurality of tables, wherein the table is selected from the plurality of tables based on a determination by the determination unit, and wherein the multi-valued data and the binary data are associated with each other in each of the plurality of tables, wherein the multi-valued data corresponds to a pixel on the printing medium and the binary data indicates either discharging or not discharging each of the first, second, or third ink droplets, wherein, in a case where any one of the first, second, and third nozzles is determined by the determination unit to be the discharge failure nozzle, the conversion unit converts the multi-valued data to the binary data based on the selected table, where the binary data is for printing by using other nozzles of the first, second, and third nozzles that are not the discharge failure nozzle, and wherein the discharge failure nozzle is not used.

2. The apparatus according to claim 1, wherein a number of second ink droplets corresponding to the binary data converted based on a table for printing by using the second and third nozzles but not using the first nozzle is more than a number of second ink droplets corresponding to the binary data converted based on a table for printing by using the first, second, and third nozzles.

3. The apparatus according to claim 1, wherein the first ink droplet, the second ink droplet, and the third ink droplet have the same ink color.

4. The apparatus according to claim 1, wherein, in a case where the conversion unit converts first multi-valued data to first binary data and converts second multi-valued data having a same gradation value as that of the first multi-valued data to second binary data, a first density of the first binary data and a second density of the second binary data are substantially the same regardless of which table from the plurality of tables is selected.

5. An image processing method which performs an image processing for printing an image by discharging an ink droplet on a printing medium with a first nozzle for discharging a first ink droplet, a second nozzle for discharging a second ink droplet which is larger than the first ink droplet, and a third nozzle for discharging a third ink droplet which is larger than the second ink droplet, the second ink droplet being discharged on a pixel subjected to the first nozzle, and the third ink droplet being discharged on a pixel subjected to the first nozzle or the second nozzle, the method comprising:

a determination step of determining 1) whether or not the first nozzle is a discharge failure nozzle in which a state of discharging is not normal, b) whether or not the second nozzle is the discharge failure nozzle, and c) whether or not the third nozzle is the discharge failure nozzle; and a conversion step of converting multi-valued data to binary data based on a table selected from a plurality of tables, wherein the table is selected from the plurality of tables based on the determination made in the determination step, and wherein the multi-valued data and the binary data are associated with each other in each of the plurality of tables, wherein the multi-valued data corresponds to a pixel on the printing medium and the binary data indicates discharging or not discharging each of the first, second, or third ink droplets, wherein, in a case where any one of the first, second, and third nozzles is determined by the determination step to be the discharge failure nozzle, the conversion step converts the multi-valued data to the binary data based on the table, where the binary data is for printing by using other nozzles of the first, second, and third nozzles that are not the discharge failure nozzle, and wherein the discharge failure nozzle is not used.

6. The method according to claim 5, wherein a number of second ink droplets corresponding to the binary data converted based on a table for printing by using the second and third nozzles but not using the first nozzle is more than a number of second ink droplets corresponding to the binary data converted based on a table for printing by using the first, second, and third nozzles.

7. The method according to claim 5, wherein the first ink droplet, the second ink droplet, and the third ink droplet have the same ink color.

8. The method according to claim 5, wherein, in a case where the conversion step converts first multi-valued data to first binary data and converts second multi-valued data having a same gradation value as that of the first multi-valued data to second binary data, a first density of the first binary data and a second density of the second binary data are substantially the same regardless of which table from the plurality of tables is selected.

* * * * *